US006035479A

United States Patent [19]

Basham et al.

[11] Patent Number: 6,035,479

[45] Date of Patent: Mar. 14, 2000

[54] SWEEPER WITH AUXILIARY BRUSH AND AUXILIARY LIP

[75] Inventors: Michael T. Basham, Maple Grove; Christopher M. Danielson, Buffalo; Joseph F. D'Costa, New Hope, all of Minn.

[73] Assignee: Tennant Company, Minneapolis, Minn.

[21] Appl. No.: 09/076,251

[22] Filed: May 12, 1998

[51] Int. Cl.[7] ..... E01H 1/04

[52] U.S. Cl. ..... 15/83; 15/340.4

[58] Field of Search ..... 15/82, 83, 84, 15/85, 86, 52.1, 340.4

[56] References Cited

U.S. PATENT DOCUMENTS 876,727 1/1908 Pevey .
5,295,277 3/1994 Koenigs et al. .

*Primary Examiner*—Robert J. Warden, Sr.
*Assistant Examiner*—Jennifer McNeil
*Attorney, Agent, or Firm*—Dorn, McEachran, Jambor & Keating

[57] ABSTRACT

A sweeper movable over a surface to be swept includes a frame having a longitudinal axis parallel to the direction of sweeper movement and a debris hopper mounted on a front portion of the frame. There is an opening in the rear of the debris hopper to admit debris. A first brush rotates about an axis transverse to the longitudinal axis of the frame and is located behind the debris hopper and has a motor for rotating the brush to throw surface debris forward into the hopper. There is a second brush which is also rotatable on an axis transverse to the longitudinal axis of the frame, with the second brush being positioned away from the surface to be swept and in front of the first brush. There is an auxiliary sweeping lip positioned closely adjacent to the second brush, which lip and the second brush add momentum to debris swept by the main brush into the hopper, so that the hopper is more fully loaded. The improvement is especially notable when sweeping light debris such as crumpled paper, leaves, etc.

9 Claims, 3 Drawing Sheets

SWEEPER WITH AUXILIARY BRUSH AND AUXILIARY LIP

THE FIELD OF THE INVENTION

The present invention relates to sweeping machines of the type shown in U.S. Pat. No. 5,295,277, owned by Tennant Company, the assignee of the present application, with the disclosure of the '277 patent being herein incorporated by reference.

There is a class of sweeping machines which contact the floor or ground being swept with a cylindrical brush that lifts debris from the surface and throws it forward directly into a debris hopper located in front of the brush. Such machines are referred to as direct forward throw sweepers and it is sometimes said that they use a "broom and dustpan" sweeping principle. The debris hopper of such a machine is open at the rear for entrance of debris and the hopper floor is set close to the ground, at least in the entrance area. U.S. Pat. No. 3,189,931 (Peabody) and U.S. Pat. No. 3,304,572 (Wendel) show representative sweepers of this class. In this discussion we will refer to the sweeping principle used in such machines as the conventional sweeping mode.

Such sweepers have been used for many years and their operating characteristics are well known. They are recognized as being extremely efficient in sweeping fine, dense debris such as sand and gravel. Starting from ground level, they throw such material in a low trajectory well forward in the hopper and easily load the hopper to its capacity. However, they do less well in sweeping and hopper loading of light debris such as, for example, crumpled paper items or dry leaves. This is primarily because air resistance checks the flight of light debris to the front of the hopper. Much of it falls in the rear of the hopper where it builds up and blocks the hopper entrance before the hopper is full.

In the mid '80's a two-tool sweeper design emerged which was much superior in loading light debris. Shown in U.S. Pat. No. 4,624,026 (Olson), it used the conventional sweeping brush, but in addition a smaller cylindrical brush or paddle wheel was placed in front of the brush so it just cleared the ground and was rotated opposite to the sweeping brush rotation. These two tools cooperatively threw debris in a much higher trajectory than direct forward throw sweepers. In this trajectory the debris entered the hopper at a higher level than before. Even light debris traveled farther forward in the hopper before it came to rest, so almost a full hopper load of it could be collected. Sweepers built to this design were outstanding in their ability to sweep and hopper load light debris.

However, they did not sweep sand and gravel as well as the direct forward throw sweepers. Sand when thrown by a sweeper brush fans out to some degree, like a shotgun pattern. This did not affect the low trajectory of the direct forward throw sweepers, but in the high trajectory of the two-tool sweepers a small portion of the sand fanned out enough to fall back into the top of the sweeping brush rather than flying forward into the hopper. The rotating brush carried it backward and dropped it behind the brush, where it could not be swept up. Only a small percentage of the sand was lost in this way, but it was enough to create dissatisfaction with sweeper operation.

A need exists for a sweeper that will sweep dense debris such as sand and gravel as efficiently as a conventional direct forward throw sweeper, and also will sweep and hopper load light debris such as crumpled paper items or dry leaves as efficiently as a two-tool sweeper. A mixture of dense and light debris should also be efficiently swept and hopper loaded.

The '277 patent disclosed a convertible sweeper which could be selectively operated in any one of three sweeping modes. In one mode, referred to as the conventional direct forward throw mode, it uses a single sweeping brush and is highly efficient in sweeping and hopper loading dense debris such as sand or gravel. In a second mode, termed a two-tool mode, it becomes a two-tool sweeper like those described earlier and does an outstanding job of sweeping and hopper-loading debris which consists primarily of light material such as crumpled paper items or dry leaves. A third mode is also disclosed which may be optimum for sweeping and hopper loading mixed dense and light debris. Thus, it provides in one machine three diverse sweeping modes.

SUMMARY OF THE INVENTION

The present invention is an improvement on what is shown in the '277 patent, as it adds an auxiliary sweeping lip which works in conjunction with a second or auxiliary brush. This auxiliary lip may be movable with or independently of that brush.

The present invention relates to sweeping machines and more particularly to a sweeping machine which utilizes a conventional sweeping brush and an auxiliary sweeping brush to control trajectory of the material being swept and is particularly advantageous in sweeping and hopper loading mixed dense and light debris.

One purpose of the invention is to provide a sweeper as described in which the auxiliary sweeping lip is located closely adjacent to the underside of the auxiliary sweeping brush and has a forwardly-facing lip which is directed upwardly so that both the lip and the auxiliary sweeping brush may slide up and over large debris objects passing under it.

Another purpose is a sweeping machine as described in which the auxiliary brush and the auxiliary sweeping lip are independently movable.

Another purpose of the invention is to provide co-rotational brushes in a sweeping machine in which the auxiliary brush or front brush sweeps against a lip or surface to add momentum to debris swept by the main brush, which is the only brush in contact with the surface being swept.

Another purpose of the invention is to provide a sweeping machine having co-sweeping brushes which provide for ballistic sweeping of light litter and permit control of its trajectory without impeding sand sweeping.

Another purpose is a sweeping machine as described which utilizes a pair of brushes rotating in the same direction to throw debris farther and harder than in prior similar designs.

Another purpose is a sweeping machine as described in which the debris trajectory can be set for preferred hopper loading by adjusting the attitude of the auxiliary sweeping lip or by changing the rotational speed of the auxiliary sweeping brush.

Other purposes will appear in the ensuing specification, drawings and claims.

BRIEF DESCRIPTION OF THE DRAWINGS

The invention is illustrated diagrammatically in the following drawings wherein.

DESCRIPTION OF THE PREFERRED EMBODIMENT

Figure 1:
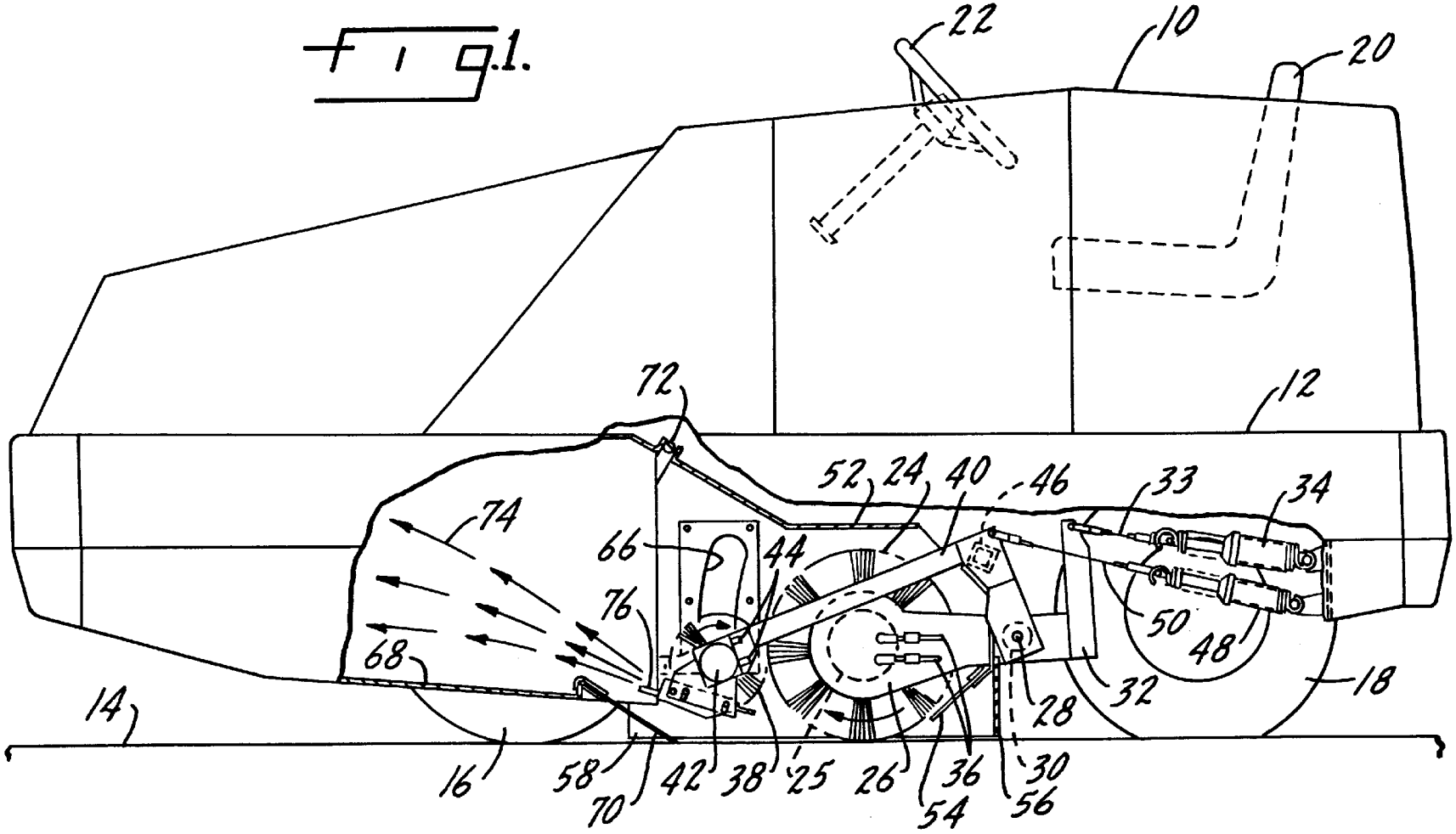
FIG. 1 is a side view of a sweeper, with portions broken away, to show the front brush and rear brush of the present invention.

Referring now to FIG. 1, at 10 there is shown a sweeper which uses a preferred embodiment of the present invention. The sweeper has a frame, shown generally at 12, and is supported on a surface to be swept 14 by two free rolling front wheels 16 (only one shown) and one steerable, powered rear wheel 18. Provisions for a driver are indicated generally by a seat 20 and a steering wheel 22. Other conventional controls are also provided, but are not shown.

Figure 6:
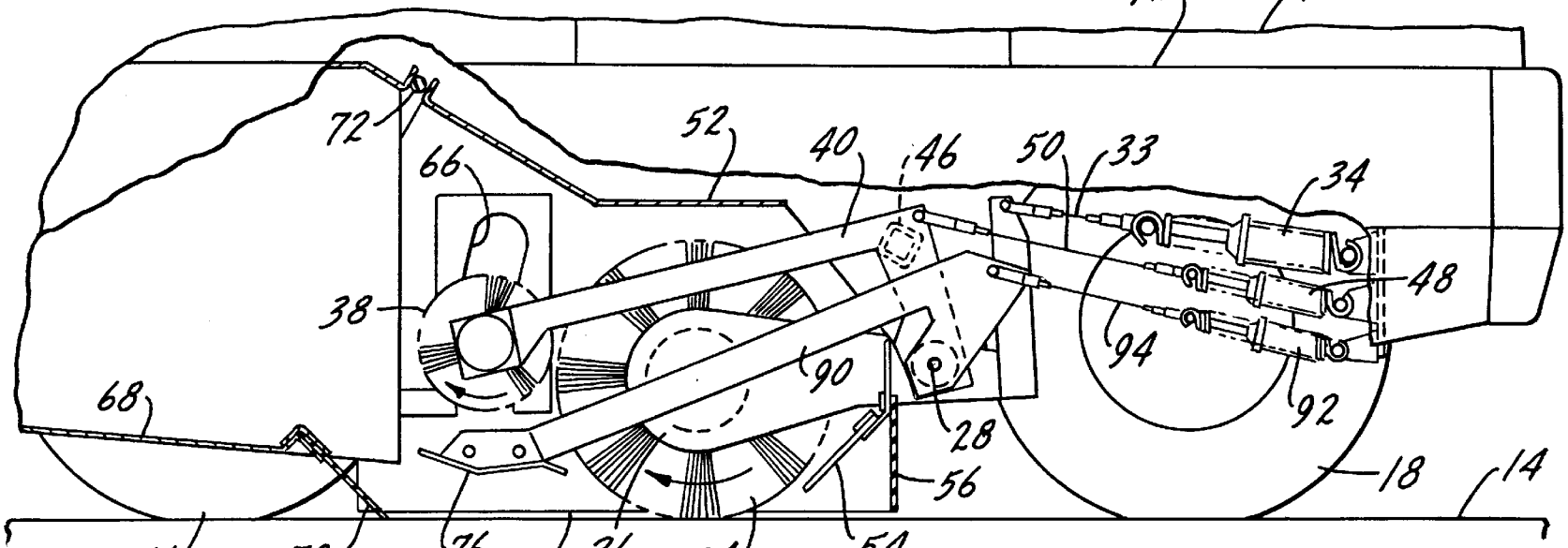
FIG. 6 is a partial side view, similar to FIG. 1, but showing a second embodiment of the invention.

A conventional cylindrical sweeping brush 24, which will be referred to as the rear brush, is mounted in a conventional manner and extends across most of the transverse width of the machine. It is supported between two brush arms 26 (only one shown) which are attached in pivotal manner to the sides of the frame 12 at two transversely aligned points 28 (only one shown). A cross shaft 30 joins the two brush arms 26 together so that both ends of brush 24 are maintained in alignment. A lift arm 32 is welded or otherwise attached to one brush arm, and is pivotally connected at its upper end to a cable assembly 33. This connects to a hydraulic cylinder 34 by means of which the brush 24 can be raised off the surface 14 for transport, or lowered to its working position which is shown in FIGS. 1 and 6. One or more helper springs 35 may assist hydraulic cylinder 34. In working position cable assembly 33 may be slack and the engagement of rear brush 24 with surface 14 may be controlled by an adjustable down stop (not shown). Brush 24 is rotated by a hydraulic motor indicated at 25 which is attached to the inboard side of one brush arm 26. This motor is supplied by hoses indicated at 36. The hydraulic system is described in the '277 patent. The opposite brush arm 26 (not shown) carries an idler bearing assembly which rotatably supports the opposite end of brush 24.

Figure 2:
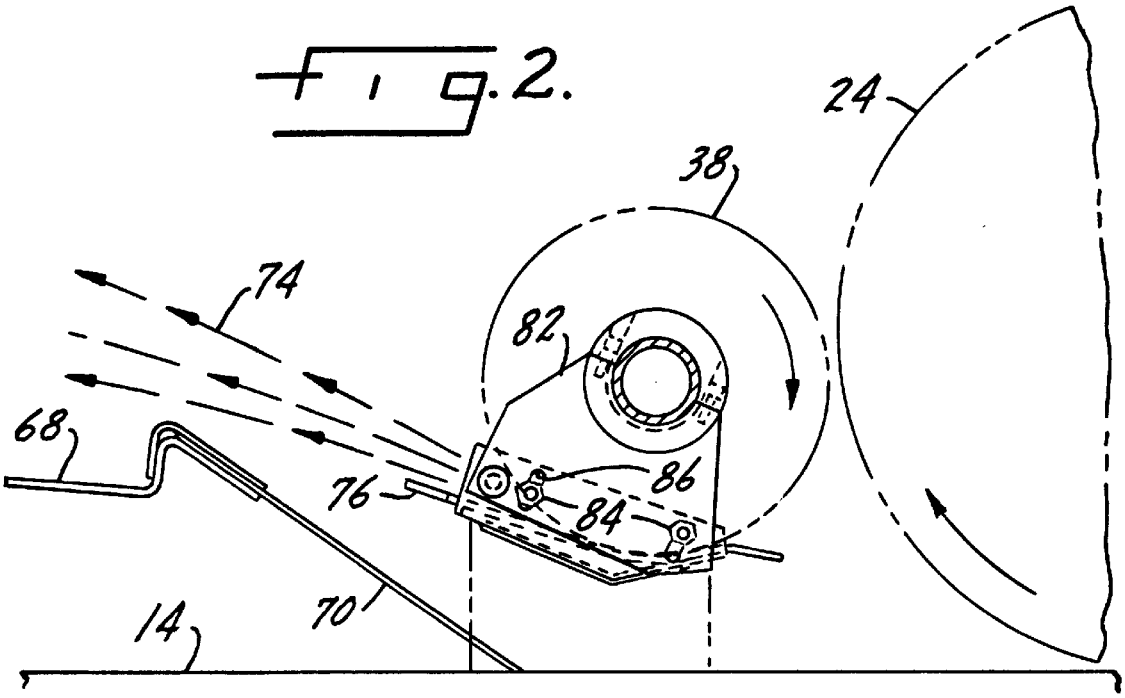
FIG. 2 is an enlarged partial side view showing the relationship between the front brush, auxiliary brush, auxiliary sweeping lip and the debris hopper.

A second tool 38 may be a cylindrical brush or a paddle wheel. In this discussion it will be referred to as the front brush. In purpose, function and construction it is similar to the rotary lip described in U.S. Pat. No. 4,624,026. It extends essentially across the transverse width of the machine, being essentially equal in length to the rear brush. It may be approximately half the diameter of the rear brush 24. Rear brush 24 rotates clockwise, as shown in FIG. 1 or 6, and front brush 38 also rotates clockwise as seen in FIG. 1, 2 or 6. The speed of front brush 38 may be set within rather wide limits; for example, if rear brush 24 is set at 400 RPM, the speed of front brush 38 may be set between 500 and 1000 RPM, with 650 RPM being perhaps a preferred speed. The rotational speed of brush 38 is important in controlling the trajectory of debris swept up by brush 24.

Figure 3:
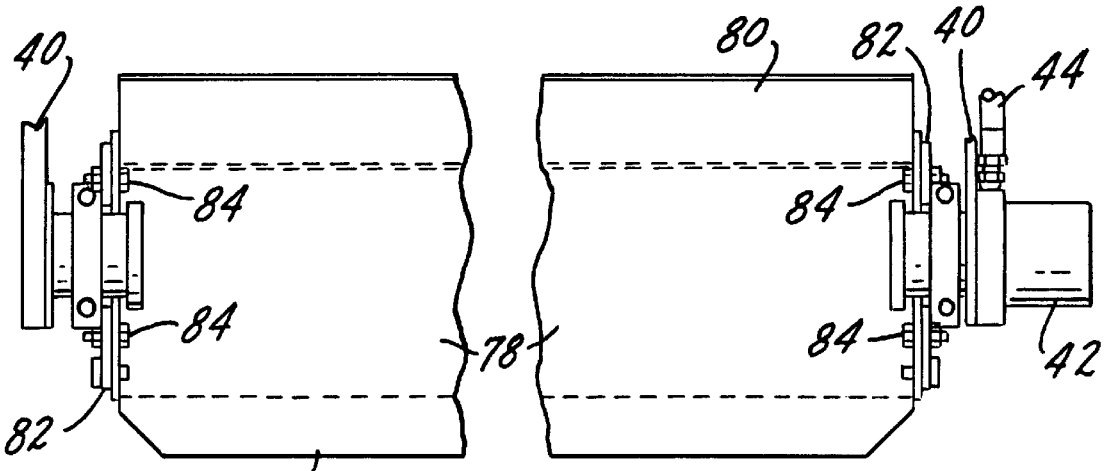
FIG. 3 is a top view, with portions broken away, of the support arms for the auxiliary sweeping brush, showing the auxiliary lip attached to the arms but with the auxiliary brush removed for clarity.

Front brush 38 is supported between two brush arms 40 and 41. A hydraulic motor 42 is mounted on brush arm 40 to rotate front brush 38 and is supplied by hydraulic hoses indicated at 44. The opposite brush arm 41 shown in FIG. 3 carries an idler bearing assembly 43 which rotatably supports the opposite end of front brush 38. A torsionally stiff cross member 46 connects brush arms 40 and 41 together so that both ends of front brush 38 stay in alignment. Brush arms 40 and 41 are pivotally mounted at two transversely aligned points 28, near the side members of frame 12. As shown in FIGS. 1 and 6, front brush arms 40 and 41 and rear brush arms 26 are pivoted at the same points 28. This is only a matter of convenience; separate pivot points might be selected.

A hydraulic cylinder 48 is connected by a cable assembly 50 to one of the front brush arms as shown in FIG. 1, or optionally the cable assembly 50 may be connected to a lug welded to cross member 46. Cylinder 48 can lower the front brush 38 to a working position shown in FIG. 1 or raise it to a stowed position. One or more helper springs 49 may assist cylinder 48.

The sweeper has structure which cooperates with rear brush 24 and also with front brush 38 to sweep debris off of surface 14. For the most part this structure is very similar to the equivalent structure found in a conventional direct forward throw sweeper, for example, as shown in U.S. Pat. Nos. 3,189,931 and 3,304,572. This structure includes a conventional brush wrap 52, which is a heavy gauge sheet steel wrapper behind and above the brushes. In a conventional sweeper the brush wrap may have slots in its rear wall through which the brush arms pass, and these slots are used in the present invention, with rear brush arms 26 passing through them. Two additional slots are added in the present invention near the top of the brush wrap for the front brush arms 40 and 41 to pass through. In conventional fashion, each slot is sealed against air leakage by a sheet rubber diaphragm (not shown) with a slit in it through which the brush arm passes. A conventional recirculation lip 54 assists in clean sweeping, and a conventional rubber drag skirt 56 assists in dust control. A door (not shown) on each side of the sweeper gives access to the brushes. Below these doors and the sweeper frame 12 there are rubber side skirts 58 which hang down almost to the surface 14 to assist in dust control. The frame side members to which the side skirts are attached have deep arcuate notches 66 cut in them to accommodate the front brush drive motor and idler bearing.

A conventional debris hopper 68 is located in front of the rear brush 24 and the front brush 38, or to the left of them as seen in FIGS. 1 and 6. It has a flexible rubber sweeping lip 70 which lifts up to admit debris to the brushes. This lip drags on surface 14 and serves as a ramp or "dust pan lip" to prevent the dense debris, such as sand thrown forward by brush 24, from being thrown under the hopper. The hopper 68 is sealed to the brush wrap 52 by a compressible seal 72. When the hopper gets full there are hydraulic means that separate it from the rest of the machine along this seal, then move and tip it as necessary for dumping it. The hopper and the means for dumping it are entirely conventional, and so will not be further described.

Figure 4:
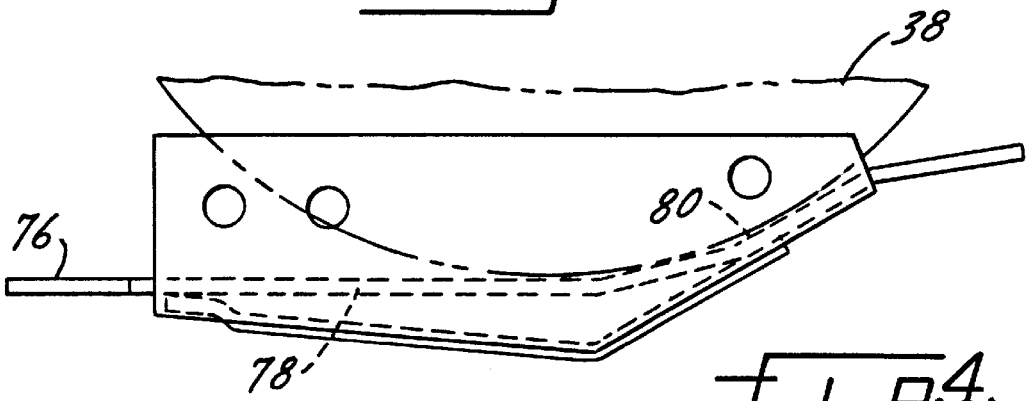
FIG. 4 is an enlarged partial side view showing the relationship between the auxiliary sweeping brush and the auxiliary sweeping lip.

Although the front brush 38 may be raised and lowered in the path of the arcuate slot 66 by the hydraulic cylinder 48, as described in the '277 patent. In the present embodiment the front brush will remain in the FIG. 1 position during normal use. The combined clockwise rotation of the two sweeping brushes will move both light and heavy debris, or a mixture thereof, in a trajectory generally along the lines of arrows 74. The front brush 38, as particularly shown in FIG. 2, is positioned closely adjacent the rear brush 24 and has an auxiliary sweeping lip 76 positioned directly beneath it. As particularly shown in FIG. 4, the sweeping lip 76 has a somewhat straight portion 78, and then a rear multi-angled portion 80. A stiffener or reinforcing piece 81 may be welded to the underside of lip 76, and two end plates 77 are welded to the ends of it. The auxiliary sweeping lip 76 will be positioned in the disposition of FIG. 2 during use and the surface of the brush 38 will just graze the upper surface of the sweeping lip 76 as the brush 38 rotates. This enables the front brush to sweep against a lip or surface and thereby add momentum to debris 39 (FIGS. 1 and 2) swept by the main brush, which is the only brush contacting the surface being swept. The debris trajectory is determined by the angle of the auxiliary sweeping lip 76, as particularly shown in FIG. 2.

The auxiliary sweeping lip 76 may be supported by a pair of brackets 82. Welded to each of these brackets is half of a circular clamp, shown as 83 in FIG. 2. The other half of each of these clamps, shown as 85 in FIGS. 2 and 3, may be secured to each half clamp 83 by two bolts. These circular clamps fit tightly around the housing of idler bearing assembly 43 and a portion of the housing of drive motor 42. Auxiliary sweeping lip 76 is supported by bolting its end plates 77 to brackets 82, using bolts 84. Elongated holes 86 permit angular adjustment of auxiliary lip 76.

As described earlier, previous forward throw sweepers were not able to sweep leaves, pine needles and other hard-to-sweep debris, and pack the debris hopper sufficiently full to meet customers' expectations. Over the top sweepers will sweep leaves, but are not typically proficient as forward throw sweepers relative to moving sand and bulky debris. The present invention combines the best of both forward throw sweeping and over the top sweeping. Of particular importance is the hopper lip design for debris entry and the placement of the front brush in proximity to an auxiliary sweeping lip for proper ballistic control of the debris trajectory. By adjusting the clearance gap between the front brush and its sweeping lip, it is possible to accommodate all aspect ratios of debris. Trajectory can be set for preferred hopper loading by adjusting the attitude of the sweeping lip or by changing front tool speed.

Figure 5:
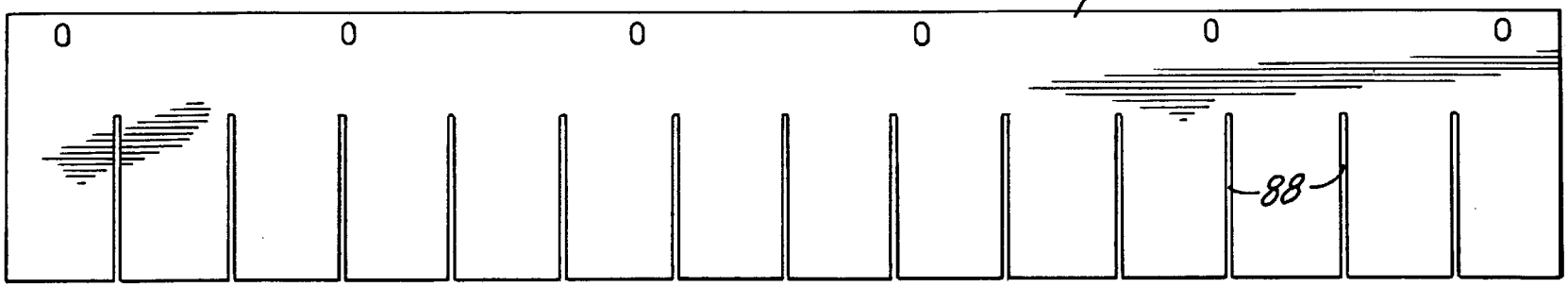
FIG. 5 is a plan view of the debris hopper lip.

FIG. 5 illustrates the flexible rubber sweeping lip 70 and is shown to have a plurality of slots 88 which will divide the sweeping lip into segments providing increased flexibility, which eases entrance of debris into the sweeping chamber.

FIG. 6 illustrates a modification of the invention in which the auxiliary sweeping lip 76 shown in the FIGS. 1–5 embodiment is movable independently of the front brush 38. In this instance the auxiliary sweeping lip 76 rather than being attached directly to the support for the front brush 38, is mounted on arms 90 which are pivotally mounted to the frame, as at 28. The arms 90 may be independently moved by a hydraulic cylinder 92 which is connected to arms 90 through a cable 94.

The embodiment in FIG. 6 provides for independent hydraulic or automatic adjustment of the space between the auxiliary sweeping lip and the front brush, whereas, in the FIGS. 1–5 embodiment, this adjustment was of necessity done in a manual fashion.

In operation, the auxiliary sweeping brush or forward brush 38 and its auxiliary sweeping lip may both move in an upward direction when large debris is encountered. The upwardly sloped section 78 of the auxiliary sweeping lip assures that any large debris encountered by the machine will not be caught, but will permit the auxiliary equipment to slide up and over the debris, making the cable slack, but then permitting the auxiliary brush arms to drop back down after the debris has passed through to the main brush.

The FIG. 6 embodiment also allows the front brush 38 and the auxiliary lip 76 to separate momentarily if pushed part by a large piece of debris being flung between them by the rear brush 24. The auxiliary brush will be lifted up and cable 50 will momentarily go slack. After the debris chunk has been ejected into the hopper the auxiliary brush will drop back to its previous position.

Whereas the preferred form of the invention has been shown and described herein, it should be realized that there may be many modifications, substitutions and alterations thereto.

The embodiments of the invention in which an exclusive property or privilege is claimed are defined as follows:

1. A sweeper movable over a surface to be swept, including a frame having a longitudinal axis parallel to the direction of sweeper movement, a debris hopper mounted on a front portion of the frame, an opening in the rear of the debris hopper to admit debris therein, a first tool comprising a rotatable cylindrical brush having an axis transverse to the longitudinal axis of the frame, said first tool being located behind the debris hopper, in the direction of movement of the sweeper, means for rotating said first tool to move debris through a particular trajectory into said debris hopper, a second tool comprising a rotatable cylindrical means having an axis transverse to the longitudinal axis of the frame, said second tool being positioned adjacent said first tool and away from the surface to be swept, means for moving said second tool toward and away from the surface being swept, and an auxiliary sweeping lip under the second tool and located closely adjacent thereto, means for rotating said second tool in the same direction as said first tool to add momentum to debris swept by the first tool and toward the debris hopper.

2. The sweeper of claim 1 wherein said second tool is a rotatable brush.

3. The sweeper of claim 2 wherein said auxiliary sweeping lip extends forwardly of said second brush and an upper surface of said auxiliary sweeping lip is closely adjacent the periphery of said second sweeping brush.

4. The sweeper of claim 2 wherein said auxiliary sweeping lip extends forwardly and upwardly toward said debris hopper.

5. The sweeper of claim 2 wherein said second rotatable brush and said auxiliary sweeping lip are upwardly movable to permit said second brush and said auxiliary sweeping lip to slide up and over large debris passing thereunder.

6. The sweeper of claim 1 wherein said auxiliary sweeping lip is movable independently of said second tool.

7. The sweeper of claim 6 wherein there are hydraulic means for raising and lowering said second tool and there are separate and independent hydraulic means for raising and lowering said auxiliary sweeping lip.

8. The sweeper of claim 1 wherein said debris hopper includes a lip extending downwardly and rearwardly from said debris hopper and in contact with a surface to be swept, said debris hopper lip being at least in part flexible at the lower end thereof.

9. A sweeper movable over a surface to be swept, including a frame having a longitudinal axis parallel to the direction of sweeper movement, a debris hopper mounted on a front portion of the frame, an opening in the rear of the debris hopper to admit debris therein, a first tool comprising a rotatable cylindrical brush having an axis transverse to the longitudinal axis of the frame, said first tool being located behind the debris hopper, in the direction of movement of the sweeper, means for rotating said first tool to move debris through a particular trajectory into said debris hopper, a second tool comprising a rotatable cylindrical means having an axis transverse to the longitudinal axis of the frame, said second tool being positioned adjacent said first tool and away from the surface to be swept, and an auxiliary sweeping lip under the second tool and located closely adjacent thereto, said second tool being movable independently of said auxiliary sweeping lip, means for rotating said second tool in the same direction as said first tool to add momentum to debris swept by the first tool and toward the debris hopper.

* * * * *